US008087211B2

(12) United States Patent
Suehiro et al.

(10) Patent No.: US 8,087,211 B2
(45) Date of Patent: Jan. 3, 2012

(54) COMPOSITE ANCHOR BOLT AND METHOD FOR INSTALLATION

(75) Inventors: Morio Suehiro, Osaka (JP); Hirokazu Suehiro, Sanda (JP)

(73) Assignee: Suehiro-System Co., Ltd., Osaka-shi (JP)

( * ) Notice: Subject to any disclaimer, the term of this patent is extended or adjusted under 35 U.S.C. 154(b) by 527 days.

(21) Appl. No.: 10/593,236

(22) PCT Filed: Aug. 16, 2004

(86) PCT No.: PCT/JP2004/011747

§ 371 (c)(1),
(2), (4) Date: Dec. 22, 2006

(87) PCT Pub. No.: WO2006/003724

PCT Pub. Date: Jan. 12, 2006

(65) Prior Publication Data

US 2008/0047223 A1 Feb. 28, 2008

(30) Foreign Application Priority Data

Jun. 30, 2004 (JP) ..... 2004-194241

(51) Int. Cl.
*E04B 1/38* (2006.01)

(52) U.S. Cl. ..... 52/745.21; 52/296; 52/297; 52/509; 52/698; 52/295

(58) Field of Classification Search ..... 52/295, 52/379, 410, 698, 707, 713, 745.21, 169.9, 52/296, 297, 509, 699; 411/44, 82, 930
See application file for complete search history.

(56) References Cited

U.S. PATENT DOCUMENTS

| | | | | |
|---|---|---|---|---|
| 1,500,870 | A * | 7/1924 | Holdredge | 52/155 |
| 2,843,234 | A * | 7/1958 | Eckel | 52/459 |
| 2,879,660 | A * | 3/1959 | Reintjes | 52/509 |
| 3,289,379 | A * | 12/1966 | Watts | 52/689 |
| 5,644,885 | A * | 7/1997 | Eischeid | 52/513 |
| 6,604,899 | B2 * | 8/2003 | Kubler et al. | 411/82 |
| 7,222,464 | B2 * | 5/2007 | Suehiro | 52/295 |
| 7,475,518 | B2 * | 1/2009 | Suehiro | 52/745.21 |

FOREIGN PATENT DOCUMENTS

| | | |
|---|---|---|
| JP | U 59-188892 | 12/1984 |
| JP | U 61-2550 | 1/1986 |

(Continued)

*Primary Examiner* — William Gilbert
*Assistant Examiner* — Patrick Maestri
(74) *Attorney, Agent, or Firm* — Oliff & Berridge, PLC

(57) ABSTRACT

A post-construction composite anchor bolt is provided having great resistance to a bending moment, even when the reinforcement covering margin is small, and reduces the transformation force caused by the bending moment acting on the joining point between the connecting part and the second anchor bolt, even if the size of the anchor bolt is increased. A post construction anchor bolt in the concrete frame comprising: a first anchor bolt installed projecting outside of a concrete frame; and a second anchor bolt which is eccentrically positioned to the axis of said first anchor bolt and is installed embedded in the concrete frame, and a connecting part which links said first anchor bolt and said second anchor bolt, and is installed embedded in the concrete frame together with said second anchor bolt. Said connecting part is formed to have a portion projecting in the opposite direction to the first anchor bolt, and thus reduces the bending moment which is exerted locally on the connecting part due to the load on said first anchor bolt.

13 Claims, 19 Drawing Sheets

FOREIGN PATENT DOCUMENTS

| | | |
|---|---|---|
| JP | U 002550 | 1/1986 |
| JP | A 08-312884 | 11/1996 |
| JP | A 2003-96918 | 4/2003 |
| JP | A 2003-096918 A | 4/2003 |

* cited by examiner

COMPOSITE ANCHOR BOLT AND METHOD FOR INSTALLATION

BACKGROUND OF THE INVENTION

1. Field of the Invention

The invention relates to a 'post-construction' anchor-bolt which is installed into the floor, wall or ceiling after a reinforced concrete frame is matured.

2. Description of the Related Art

Prior post-construction anchor bolts are classified into adhesive anchors and driving anchors (metal-formed extendable anchors), which each consist of various types. In the installation of a post construction adhesive anchor, a capsule filled with adhesive or adhesive itself is embedded into a borehole which has been drilled in advance in a concrete frame, the anchor bolt is inserted, and when the adhesive cures, the concrete and anchor bolt fasten together to complete the installation.

The greatest problem experienced in the installation of conventional post construction anchor bolts is the existence of reinforcement in the concrete. It is not possible to install a post-construction anchor bolt if the anchor bolt borehole encounters reinforcement. Therefore, the inventor proposed a composite anchor bolt which forms a crank, where an anchor bolt projects from the concrete surface and another anchor bolt is embedded inside the concrete. See Japanese Unexamined Patent Publication (kokai) No. 2003-96918.

The disclosure of the specification of the patent publication mentioned above relate to a first anchor bolt, a connecting part, and a second anchor bolt, and their relationship as shown in FIGS. 17 and 18. Specifically, the structure comprises a flat and oblong connecting part 1 with a first anchor bolt 2 installed at one end of the top surface, and a second anchor bolt 3 installed at the opposite end of the underside of connecting part 1. Consequently, the relationship between first and second anchor bolts 2, 3 is that they are mutually on a eccentrically positioned axis. In the installation, connecting part 1 and second anchor bolt 3 are embedded inside concrete frame 4, and first anchor bolt 2 is installed projecting from the surface of concrete frame 4. Thus, even if reinforcement 5 is present in the position of installation for the first anchor bolt, the second anchor bolt can be embedded in a position out of alignment with the position of reinforcement 5 so that the installation can be completed. The first anchor bolt 2 penetrates and projects connecting part 1, this projecting portion is the adhering portion which attaches it to concrete frame 4.

However, for an anchor bolt of a larger diameter, connecting part 1 must also become larger in order to increase the strength of connecting part 1, but it is then not possible to have adhering portion 6 for the first anchor bolt, see FIG. 19. As shown in the figure, the depth of connecting part 1 covers the area of reinforcement covering margin 5.

Said composite anchor bolt works particularly effectively when reinforcement is present in the anchor bolt embedding position. However, if the dimensions are greater, the load on the anchor bolt projecting from the concrete surface will be greater. Therefore, problems can occur, such as bending at the joining point of the connecting part and the anchor bolt (embedded in the concrete), which is caused by an excessive bending moment exerting force on the connecting part Specifically, if tensile force T(KN) acts on the first anchor bolt 2, point C does not shift because of an adequate tensile force between the second anchor bolt and frame, but a bending moment of T×x(KN·cm) does act on point C. If this bending moment increases, joining point C of connecting part 1 and second anchor bolt 3 will bend, therefore damaging the anchor bolt. The concrete adhering margin (the shortest distance between the concrete surface and the reinforcement) is generally 30-60 mm. Therefore, the connecting part can be 30-60 mm thick at the most (in proportion to the diameter of the increasing bolt size). Consequently, the use of the traditional type of anchor bolt cannot be adopted by scale-up only. An anchor bolt having a large diameter can bend easily at point C when there is a bending moment.

The present invention focuses on such conventional problem areas by alleviating the transformation force induced by a bending moment acting on the joining point between the connecting part and the second anchor bolt (even for a larger anchor bolt). The objective of the invention is to provide a post construction composite anchor bolt having good resistance to a bending moment, even if the reinforcement covering margin is shallow, and a method for its installation.

SUMMARY OF THE INVENTION

The composite anchor of the present invention comprises a first anchor bolt installed projecting outside of a concrete frame; a second anchor bolt which is positioned eccentrically to the axis of said first anchor bolt; and a connecting part for connecting said first and second anchor bolts, characterized in that said connecting part is provided with projecting portion which projects in the opposite direction to the first anchor bolt, and thus reduces the bending moment which is exerted locally on the connecting part due to a load on said first anchor bolt.

In this situation, said planar configuration of the connecting part is made to be a polygonal or circular shape, so that it is possible to increase the compressive force transfer area due to said projecting portion. Furthermore, with said planar connecting part formed in a polygonal or circular shape, it is also possible to place said second anchor bolt in the center of the connecting part. Alternatively, it is desirable that adhesive can be injected with said connecting part having an injection hole and air hole. Also, said first anchor bolt and said second anchor bolt are preferably formed of similar and also different diameters. Furthermore, said second anchor bolt has a larger diameter than said first anchor bolt, and is preferably formed with a shorter length in the embedded concrete.

Also, the present invention is a composite anchor bolt which comprises a first anchor bolt installed projecting outside of the concrete frame; a second anchor bolt which is eccentrically positioned to the axis of said first anchor bolt; and a connecting part for connecting said first and second anchor bolts, characterized in that the center of said connecting part and the axis of the first anchor bolt are coaxial, a planar configuration of said connecting part is formed in a polygonal or circular shape, and a second anchor bolt can be selectively positioned in a certain circumference.

In this construction, the connecting part is formed in either a cylindrical, triangular, quadrangular or polygonal shape to increase its surface area, so that it is possible to increase the adhering area of the composite anchor with the concrete. Also, it is preferably constructed with additional reinforcing portion which resist against the bending moment exerting locally on the joining point between said second anchor bolt and connecting part. Also, said first anchor bolt and said second anchor bolt are preferably formed with similar or different diameters. Said second anchor bolt may have a larger diameter than said first anchor bolt, and is preferably formed with a shorter length in the embedded concrete. Furthermore, said connecting part can provide an injection hole for an adhesive and air hole, and at least one of said first anchor bolt and second anchor bolt can be removably attached to said connecting part.

The composite anchor bolt of the present invention may comprise a first anchor bolt installed projecting outside of the concrete frame; a second anchor bolt which is eccentrically positioned to the axis of the said first anchor bolt; and their connecting part, wherein said connecting part and second anchor bolt are formed in a T-shape configuration, and said first anchor bolt is preferably placed at the end side of the connecting part.

Said first anchor bolt and said second anchor bolt can be removably attachable to said connecting part.

According to the present invention, the method of installing a composite anchor bolt of the above construction comprises: preparing a composite anchor bolt which comprises a first anchor bolt projecting on the outside and a second anchor bolt which is positioned eccentrically to the first anchor bolt, and a planar connecting part linking the first and second anchor bolts; removing a cylindrical or polygonal core from the reinforcement covering margin to confirm the position of the reinforcement when reinforcement is encountered in the anchor borehole position, said core corresponding to the shape of said connecting part and surrounding the borehole; drilling a borehole for said second anchor bolt; and jointly attaching said composite anchor bolt.

In this situation, after the borehole for the said second anchor bolt is prepared, an adhesive is preferably injected into the adhesive injection hole which is formed in said connecting part, air escapes from the air hole formed in said connecting part, and said composite anchor bolt is fixed with the adhesive. Furthermore, a portion of the said connecting part preferably projects from inside of the concrete frame, and the equipment base is placed on the said connecting part and attached with said first anchor bolt.

According to the composite anchor bolt of the present invention, there is a force acting on the joining portion of the connecting part and the second anchor bolt caused by a bending moment which occurs due to the tensile force acting upon the first anchor bolt, the projecting portion of the connecting part acts to generate compressive force on the concrete frame, the force occurring due to this provides resistance to the bending force, thus in the connecting part of the composite anchor bolt, the bending moment acting on the second anchor bolt according to the 'lever' principle is reduced. Therefore, even if the reinforcement covering margin is limited, it is possible to provide a large size of composite anchor bolt with high load resistance function.

Furthermore, previously, when reinforcement is encountered, bad construction practices are commonly used such as the cutting of reinforcement and using anchor bolts of incorrect length. However, the composite anchor bolt of the present invention provides for proper installation without interfering with the reinforcement in the concrete frame, therefore guaranteeing the design strength of the building structure.

Furthermore, in prior methods of installation, the frame is cut until the reinforcement is exposed, the anchor bolt is then welded, the frame is filled with concrete, and the concrete is cured until hard to complete the installation. In the composite anchor bolt of present invention, cutting, welding, concrete filling, and cutting waste disposal operations are all unnecessary. This reduces the emission of environmental indicator $CO_2$, reduces labor, and enables the planning of shorter construction times because the curing period is significantly shorter.

DETAILED DESCRIPTION OF THE PREFERRED EMBODIMENT

Figure 1:
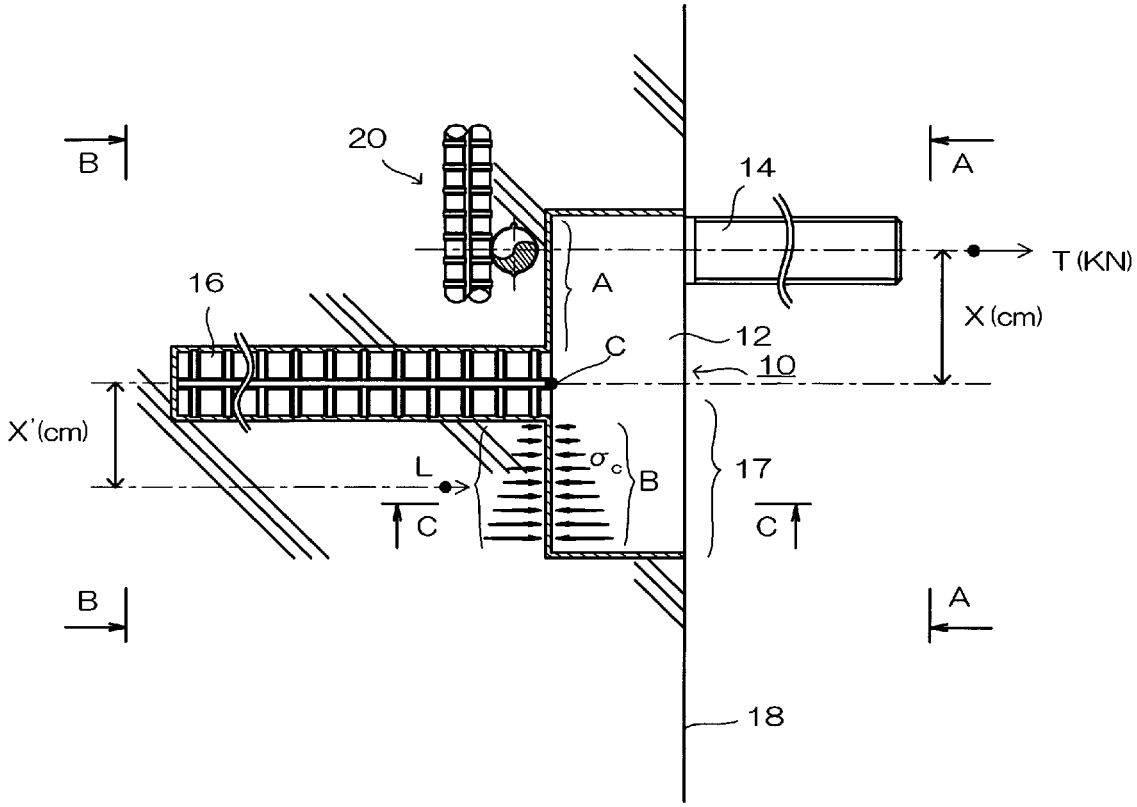
FIG. 1 is a side view of T-shaped composite anchor bolt in the first embodiment.
Figure 2:
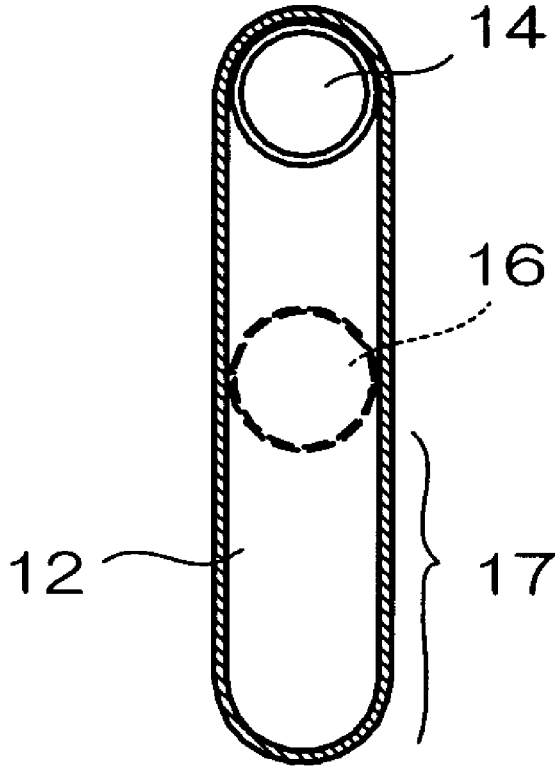
FIG. 2 is a view taken in the direction of the arrows A-A in FIG. 1.
Figure 3:
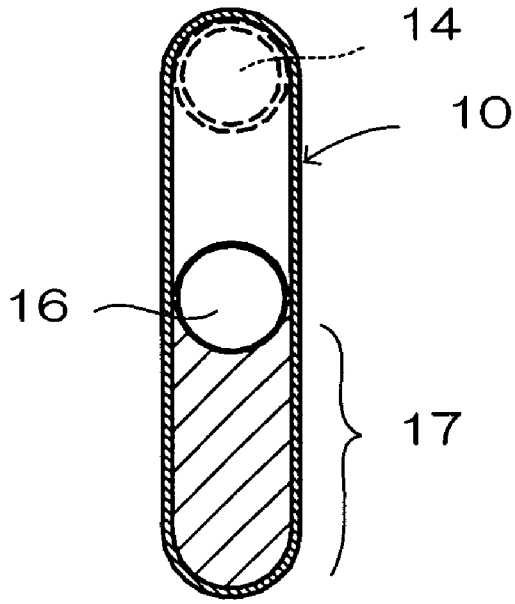
FIG. 3 is a view taken in the direction of the arrows B-B in FIG. 1.
Figure 4:
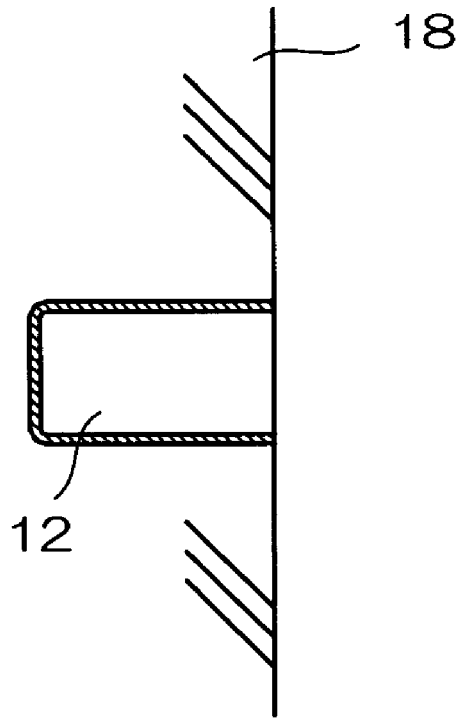
FIG. 4 is a cross-sectional view taken along the line C-C of FIG. 1.

The best mode of the composite anchor bolt of the present invention and the method for its installation will be described in detail, referring to the accompanied drawings. FIG. 1 shows the side view of the T-shaped composite anchor bolt according to the first embodiment of the present invention. FIG. 2 shows a view taken in the direction of the arrows A-A in FIG. 1. FIG. 3 shows a view taken in the direction of the arrows B-B in FIG. 1. FIG. 4 shows a cross-sectional view taken along the line C-C of FIG. 1.

The composite anchor bolt of the present embodiment is post-constructed into a concrete frame. It comprises a first anchor bolt installed projecting from outside of the concrete frame, and a second anchor bolt positioned eccentrically to the axis of said first anchor bolt, and a connecting part installed embedded in the concrete frame together with said second anchor bolt. On the said connecting part, a projecting portion is formed in the opposite direction to the first anchor bolt, and the projecting portion reduces the bending moment which is exerted locally on the connecting part due to the load on said first anchor bolt.

As shown in the figures, T-shaped composite anchor bolt 10 is integrally formed of the rectangular block of connecting part 12 having an oblong surface (as shown in FIG. 2), and a first anchor bolt 14 and second anchor bolt 16 positioned on both sides of the oblong surface. Specifically, its construction provides a first anchor bolt 14 positioned at one end of the oblong on the top surface of connecting part 12, while a second anchor bolt 16 at the central part of the oblong on the underside of connecting part 12 with an axis running parallel to said first anchor bolt 14, so that both axis are eccentrically positioned. As shown in FIGS. 2 to 4, the width of connecting part 12 is approximate to the diameter of first and second anchor bolt 14, 16. In a state where first anchor bolt 14 is removed, connecting part 12 and second anchor 16 bolt form a 'T-shaped' anchor in the side view, and when first anchor bolt 14 is attached in the construction, it forms T-shaped composite anchor bolt 10. Because of this, the half portion of connecting part 12 is comprised of projecting part 17 (hatching section in FIG. 3) formed in the opposite direction to the first anchor bolt and around the second anchor bolt 16. In accordance with the existence of projecting part 17, if tensile force T(KN) acts on said first anchor bolt, it will reduce the bending moment which is exerted locally on connecting part 12 due to that load (see FIG. 1).

Said first anchor bolt is placed projecting from the surface of concrete frame 18, and serves as a fixing screw portion which is used to mount various fixings and appliances to the surface portion of concrete frame 18. On the other side, a second anchor bolt 16 positioned on the underside of connecting part 12 is embedded inside concrete frame 18. In order to prevent second anchor bolt 16 being pulled out of concrete frame 18, the surface is formed of reticulated ridges to increase the frictional resistance and adhering area with concrete frame 18 and thus establish greater adherence. Connecting part 12 is partly embedded into concrete frame 18 together with second anchor bolt 16, but the side for fixing the first anchor bolt 14 is embedded to flush with the surface of concrete frame 18.

If reinforcement frame 20 exists at the anchoring site in the concrete when positioning the anchor bolt for installation at the predetermined site of hardened and matured concrete frame 18, the T-shaped composite anchor bolt 10 of the present embodiment can be used in place of a normal rod-shaped anchor bolt. Specifically, if reinforcement frame 20 is encountered when a borehole is drilled in order to drive a normal anchor bolt into concrete frame 18, composite anchor bolt 10 of the present embodiment can be used.

In the actual installation operation, when reinforcement frame 20 is encountered during work on the position for the anchor borehole, the position of first and second anchor bolt 14, 16 is shifted out of alignment by eccentric distance x to avoid reinforcement frame 20 in a direction away from the bar arrangement of reinforcement frame 20. Work is then conducted on the borehole for the second anchor bolt 16. After that, an oscillating drill and diamond cutter having a disk sander are used to form a groove which receives said connecting part 12, so that both borehole sections are linked.

After both borehole sections and the groove are cleaned, an adhesive capsule is inserted in the boreholes, and composite anchor bolt 10 of the present embodiment is driven in using a hammer. The gaps between concrete frame 18 and connecting part 12 are then sealed with caulk, the adhesive is left to harden, so that the installation is completed. Preferably, the second anchor bolt 16 has the reinforcement configuration and entire threaded rod configuration having an uneven surface, so that the adhering area of second anchor bolt 16 with the adhesive is increased.

If tensile force T(KN) acts on the first anchor bolt of the composite anchor bolt constructed according to the present embodiment, the bending moment will work in a clockwise rotation around point C in the half portion of section A of connecting part 12, which is positioned on the side of first anchor bolt 14. On the other side, a similar bending moment will work around point C in the half portion of section B of projecting portion 17, so that the concrete face is compressed.

The second anchor bolt 16 is embedded with the correct fixing length in concrete frame 18, therefore it is firmly fixed below point C. If T(KN) acts on first anchor bolt 14, a compressive force will act on section B around the fulcrum of point C.

Therefore, when the relationship represented by following formula is established, the force of the bending moment acting on point C becomes smaller, and the force acting to separate section A from the concrete adhering surface also becomes smaller:

$$T \times x(KN^{*}\text{cm}) = \Sigma\sigma_e \times x' = L \times x'(KN^{*}\text{cm}) \quad \text{[formula 1]}$$

(In this regard, L is the sum (KN) of the reaction force, x' is the distance (cm) to the centre of the reaction force). Also, connecting part 12 is firmly fixed as shown in cross-section C-C in FIG. 4, therefore it does not separate from the concrete face due to tensile force T(KN). Furthermore, the entirety of connecting part 12 adheres to the concrete, thus adherence corresponding to a large surface area can be expected to resist against tensile force T(KN).

Because a sufficiently firm and strong concrete surface is obtained, the reaction force corresponding to the compressive force resists the force of the bending moment applied on section B. Also, the bending moment and reaction force do not place strain on connecting part 12 because connecting part 12 has a firm cross section.

For the large type of T-shaped composite anchor bolt 10, a slightly greater force than that of T(KN) on first anchor bolt 14 acts on point C according to the lever principle, and therefore, the diameter of second anchor bolt 16 is preferably designed with a slightly larger diameter than that of first anchor bolt 14.

Figure 5:
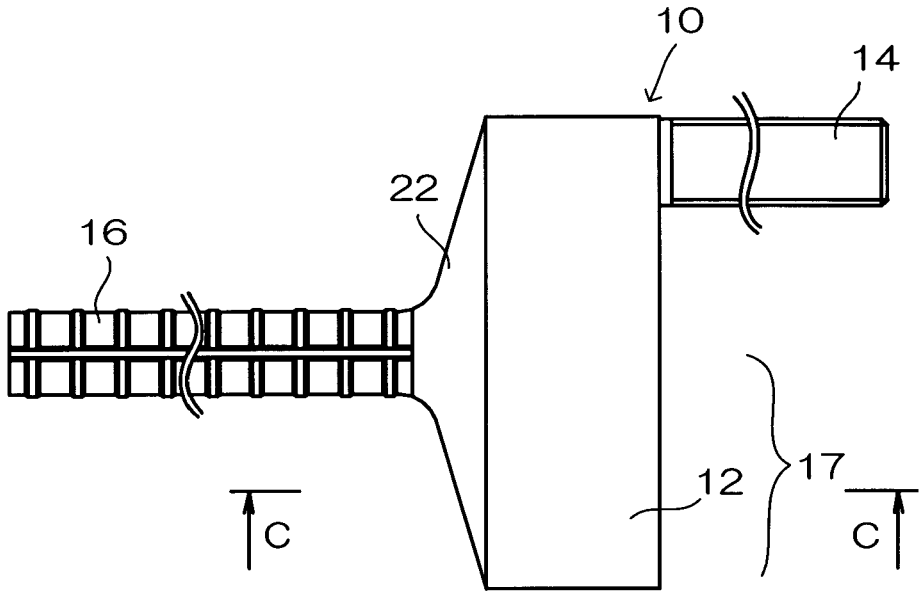
FIG. 5 is a side view showing a variation of the first embodiment.
Figure 6:
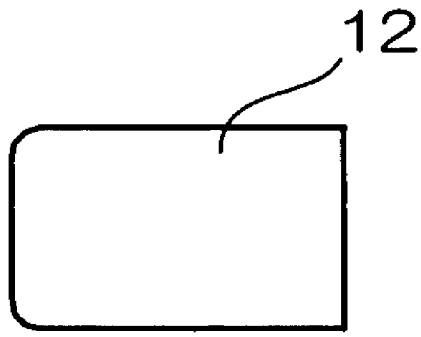
FIG. 6 is a cross-sectional view taken along the line C-C of FIG. 5.

Also, as shown in FIGS. 5 and 6, the corner of connecting part 12 and second anchor bolt 16 can be provided with a reinforcing portion 22 or triangular brace configuration.

Also, connecting part 12, first anchor bolt 14 and second anchor bolt 16 are preferably formed as an integral molded component, but they can be separate parts which can be assembled by means of welding or joining parts such as screws. Furthermore, an anchor bolt of a metal-formed extendable anchor (driving or clamping type) is also possible for second anchor bolt 16 in place of the adhesive type.

Figure 7:
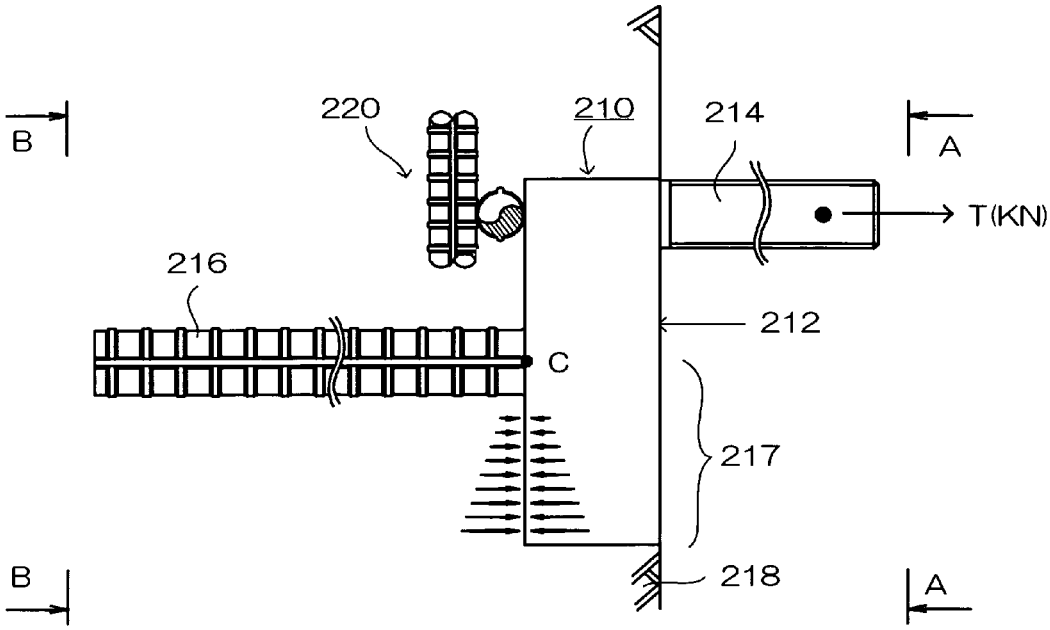
FIG. 7 is a side view of circular type composite anchor bolt according to the second embodiment.
Figure 8:
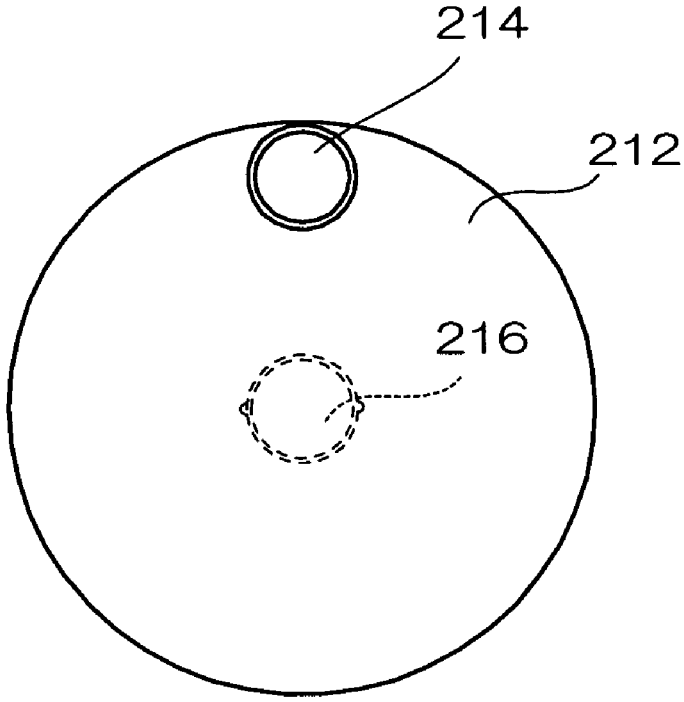
FIG. 8 is a view taken in the direction of the arrows A-A in FIG. 7.
Figure 9:
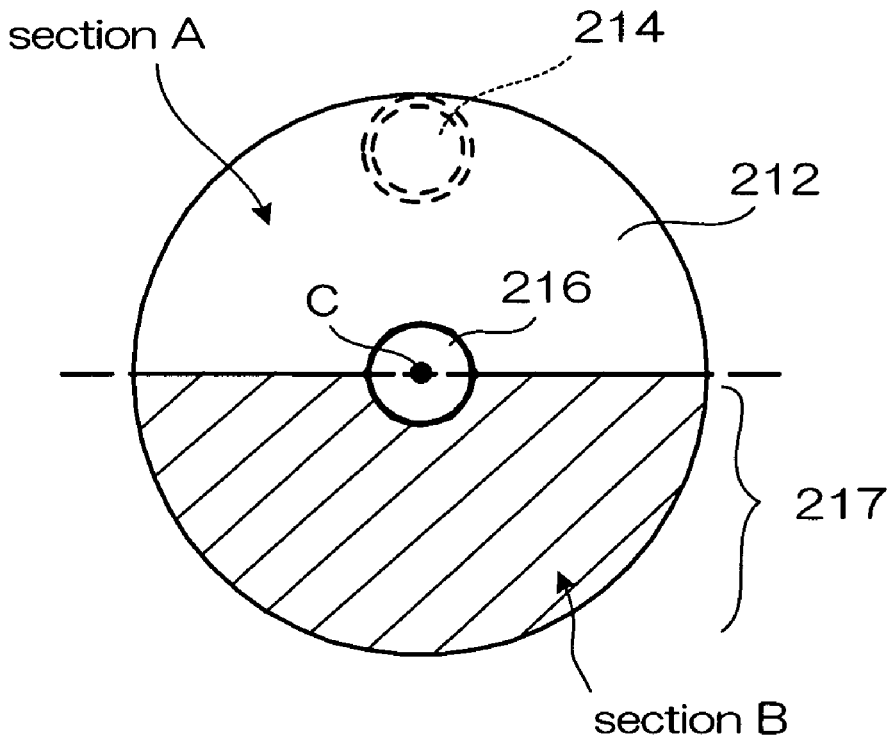
FIG. 9 is a view taken in the direction of the arrows B-B in FIG. 1.

FIG. 7 is an explanatory drawing of the circular type of composite anchor bolt according to the second embodiment. FIG. 7 is a side view of the anchor bolt set inside of concrete frame 218. FIG. 8 shows a view taken in the direction of the arrows A-A in FIG. 7. FIG. 9 shows a view of taken in the direction of the arrows B-B in FIG. 7.

210 in the figure denotes the large, circular type of the composite anchor bolt in the second embodiment. In the present embodiment, a circular or planar connecting part 12 is used in place of the connecting part 12 having oblong surface in the aforementioned T-shaped composite anchor bolt. This point distinguishes the second embodiment from the first embodiment.

214 in the figure denotes the first anchor bolt, and extending along its axis is reinforcement frame 220. In short, during borehole drilling for installation of a normal anchor in concrete frame 218, reinforcement frame 220 is encountered, therefore a circular type of composite anchor bolt is used.

Second anchor bolt 216 is provided at the central section of the rear side of a circular connecting part 212, and first anchor bolt 214 is provided on the surface at a point in the circumference, eccentrically positioned by x distance. A borehole is drilled at a point where reinforcement does not exist, separated from the point where reinforcement was encountered by a distance of x, and adhesive is used for the installation. Preferably, the second anchor bolt 216 has the reinforcement configuration and entirely threaded rod configuration with an uneven surface configuration, so that the adhering area of the second anchor bolt 216 with the adhesive is increased.

The aim of circular connecting part 212, which links the first anchor bolt 214 and second anchor bolt 216, is to increase the surface area and cross-section area of the aforementioned connecting part 212 between the concrete surface and the reinforcement covering margin, and is formed in a circular configuration (triangular, quadrangular, and polygonal are also possible). Connecting part 212 is divided into the two half portions by the line passing through point C which is the fixing point for second anchor bolt 216: section A which include the fixing point first anchor bolt 214, and section B which is other than section A (See FIG. 9). If tensile force T (KN) acts on first anchor bolt 214, the bending moment will work in a clockwise direction around point C in section A. With a similar bending moment acting around point C in section B also, the concrete surface becomes compressed. Because a sufficiently firm and strong concrete surface is obtained, the reaction force corresponding to the compressive force resists the force of the bending moment applied on section B. Also in circular connecting part 212, as shown in FIGS. 8 and 9, the first anchor bolt 214 is fixed at one point in the circumference, and second anchor bolt 216 is fixed in proximity to the center of the circle. At the same time, the positions of first anchor bolt 214 and second anchor bolt 216 are freely selectable depending on the purpose thereof.

For the circular type of composite anchor bolt 210, a slightly greater force than that of T(KN) on first anchor bolt 214 acts on point C, according to the lever principle, and therefore, the diameter of second anchor bolt 216 is preferably designed with a slightly larger diameter than that of first anchor bolt 214.

Figure 10:
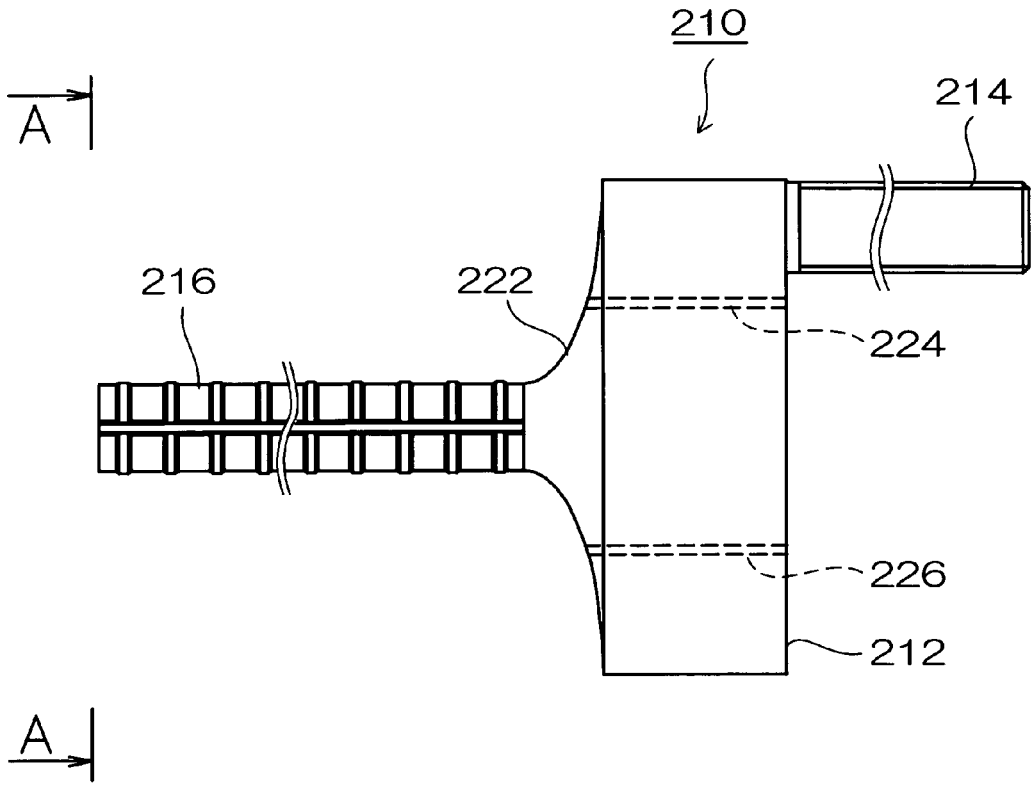
FIG. 10 is a side view showing a variation of the second embodiment.

Also, FIG. 10 shows an exemplary variation of the second embodiment. As shown in the figure, the corner of second anchor bolt 216 and circular connecting part 212 can be provided with reinforcing portion 222 or triangular brace configuration.

Also, circular connecting part 212, first anchor bolt 214 and second anchor bolt 216 are preferably formed as an integral molded component, but they can be separate parts which can be assembled by means of welding or joining parts such as screws. Furthermore, an anchor bolt of a metal-formed extendable anchor (driving or clamping type) is also possible for second anchor bolt 216 in place of the adhesive type.

Figure 11:
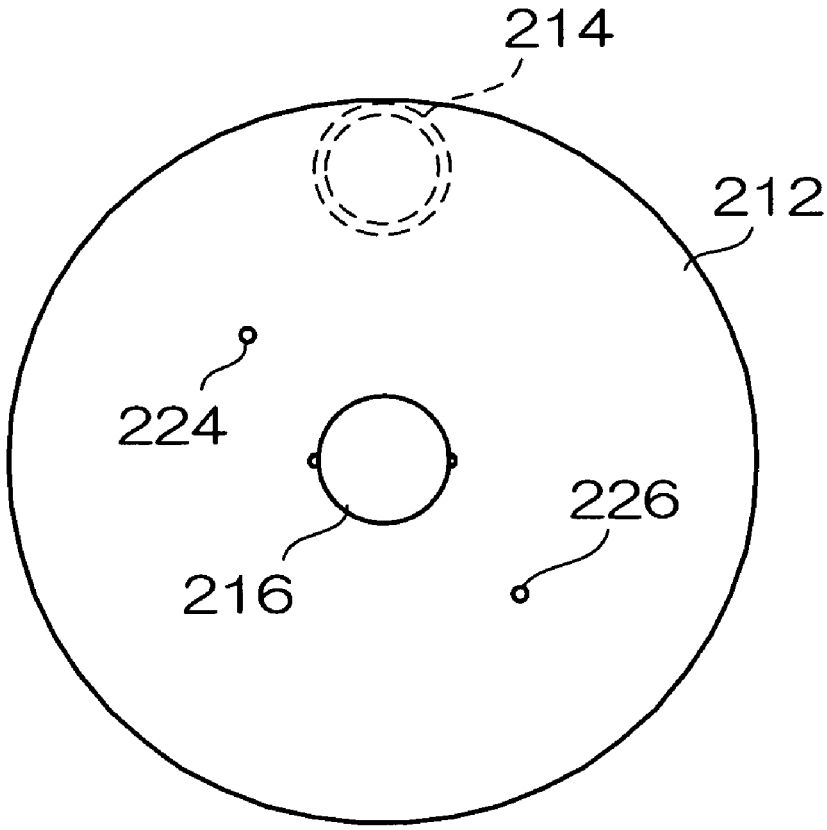
FIG. 11 is a view taken in the direction of the arrows A-A in FIG. 10.

Also, as shown in FIGS. 10, 11, circular connecting part 212 is preferably provided with a drilled adhesive injection port 224 and an air release hole 226. Several adhesive injection ports 224 and several air release hole 226 having various locations, can be freely located and formed at points that do not weaken the strength of circular connecting part 212. The connecting part 212 can be provided with these holes whether the configuration thereof is T-shaped, circular, or other.

The effectiveness of the adhesive injection port is seen when the composite anchor bolt is fixed to a wall or a ceiling. Second anchor bolt 216 is set in the borehole with an adhesive capsule, and the composite anchor bolt is attached. When the adhesive for the circumference of connecting part 212 is injected first, it leaks out from the wall or ceiling surface 212 due to the liquid consistency of the adhesive. In order to solve this problem, after the second anchor bolt 216 is set in the borehole, the adhesive is injected through adhesive injection port 224 to the circumference of connecting part 212, air then escapes from air release hole 226, thus the permeation of the adhesive is proved, and completion of adhesive injection process can be guaranteed at the same time.

Figure 12:
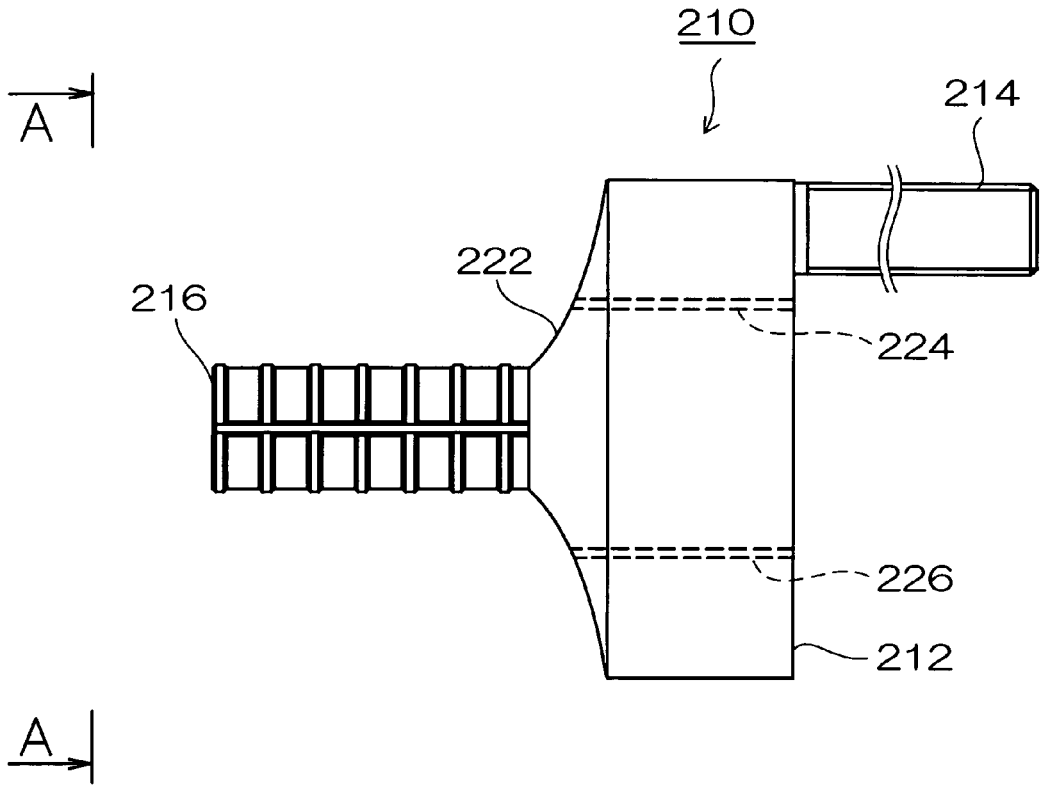
FIG. 12 is a side view of anchor bolts having different diameters according to the second embodiment
Figure 13:
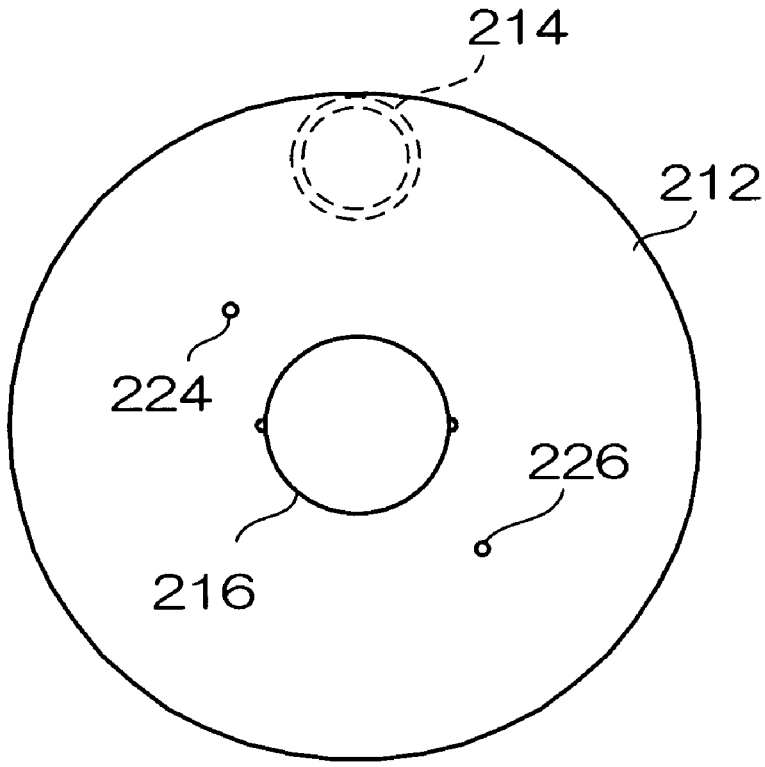
FIG. 13 is a view taken in the direction of the arrows A-A in FIG. 12.

For the circular type of composite anchor bolt in the second embodiment, the case where both the first and second anchor bolt have the same diameter has been explained but, as shown in FIGS. 12, 13, the diameter of second anchor bolt 216 can be formed slightly larger than that of first anchor bolt 214. In this manner, an increase in the essential surface area for adherence to the embedded concrete, according to the size increase in the diameter of the anchor bolt, can be guaranteed. In addition, the bolt diameter of this second anchor bolt may be optionally variable as long as essential strength is obtained in the area embedded in the concrete.

Furthermore, when second anchor bolt 216 is formed with a larger diameter than that of first anchor bolt 214, an increase in the essential surface area for adherence to the embedded concrete can be guaranteed in accordance with the larger diameter of the second anchor bolt. Therefore, the second anchor bolt can be formed with a shorter length in the embedded concrete. In addition, due to the second anchor bolt having a larger diameter, the area forming a shorter length in the embedded concrete is optionally variable as long as essential strength is obtained.

Drawing 14 shows the third embodiment. The third embodiment is the circular type of composite anchor bolt 310 in which second anchor bolt 316 can be freely positioned on the circumference of radius x from the axis of first anchor bolt 314.

Differing from the compressive force of the aforementioned lever principle, connecting part 312 is formed as a cylinder of increased size in order to increase the adherence in place of the compressive force. Note that polygonal configurations having triangular, quadrangular, or polygonal surface are also possible. Furthermore, it is constructed in such a manner that connecting part 312 and first anchor bolt 314 have the same axis, and second anchor bolt 316 is positioned in the circumference of radius x around the first anchor bolt 314.

This composite anchor bolt is characterized by its workability.

When the borehole of the first anchor bolt encounters the reinforcement frame, in the prior composite anchor bolt, a hole is drilled for the second anchor bolt which is positioned away from the first borehole by distance x. However, hitting the reinforcement again in subsequent position is also a possibility. In other words, the aforementioned procedure could be repeated until a borehole is located in a location where reinforcement does not exist.

Figure 14:
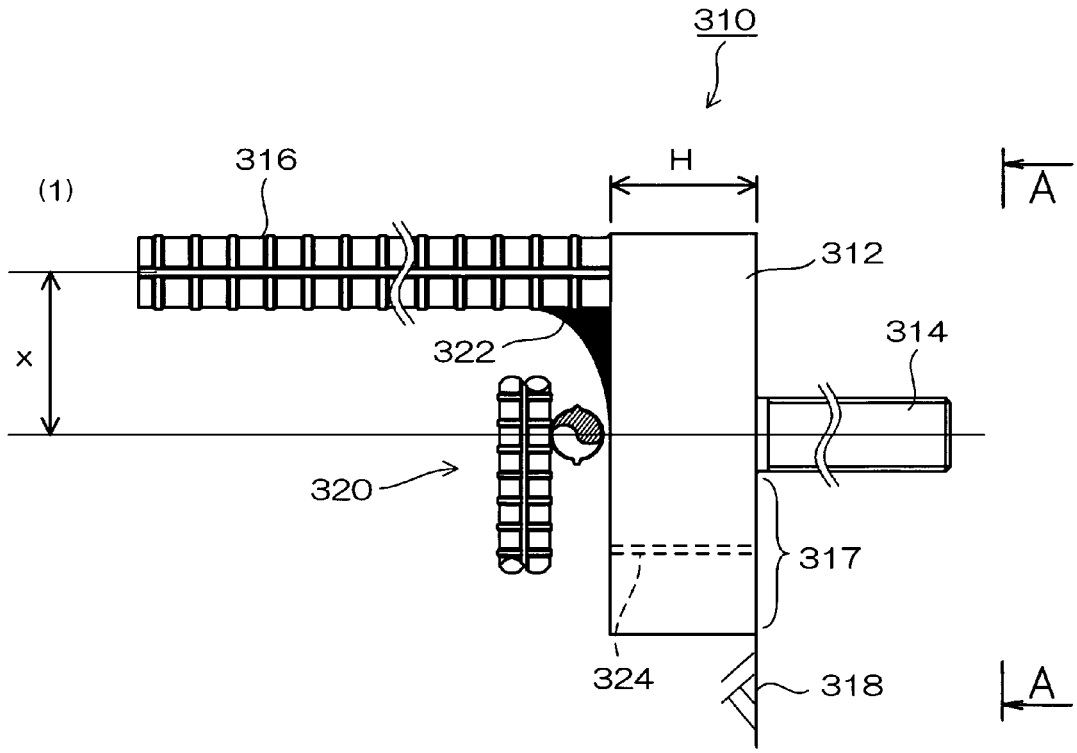
FIG. 14 is a side view of circular type composite anchor bolt according to the third embodiment.
Figure 15:
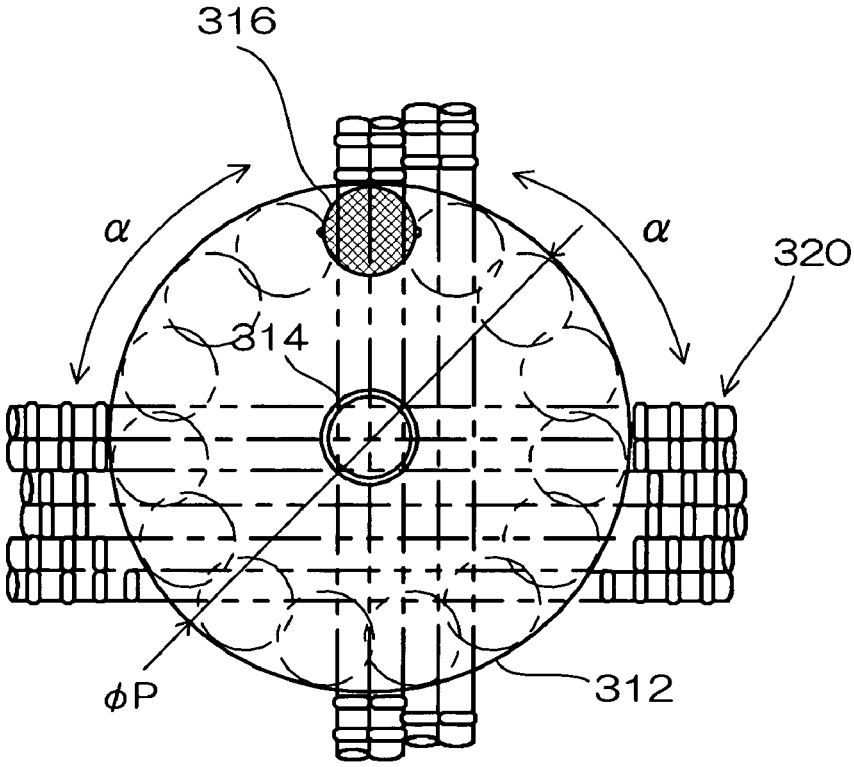
FIG. 15 is a view taken in the direction of the arrows A-A in FIG. 14.

Thus, in the circular type of composite anchor bolt 310 in the third embodiment, a core is drilled in the circumference, shown in FIG. 15 (view taken in the direction of arrows A-A in FIG. 14), to a depth of H (the reinforcement covering margin) and diameter of $\phi$P. Naturally, the reinforcement is not cut this time. When a concrete core of the $\phi$P×depth H is removed, the reinforcement frame 320 can be seen. Suppose that the reinforcement bars are arranged on top of one another, for example, as shown in view from arrows A-A. Looking at the arrangement of the reinforcement, it can be discerned that a borehole for the second anchor bolt 316 can be drilled in the $\alpha$ (alpha) section which is squeezed in by intersecting reinforcement 320. A borehole for the second anchor is drilled in a section, and the circular type of composite anchor bolt 310 in the third embodiment is installed. The position of the axis of the concrete borehole coincide with that of the first anchor bolt and the connecting part, therefore the circular type of composite anchor bolt 310 can be fixed into concrete frame 318 easily.

Since the joining point between connecting part 312 and second anchor bolt 316 has weakness against a bending moment, it is necessary to provide a reinforcing portion 322 to compensate for the weakness, thus increasing surface area of the entire connecting part and obtaining greater adherence of the connecting part with the concrete.

The method of installation for the composite anchor bolt in the third embodiment can be carried out as follows.

In the prior art composite anchor bolt, a first anchor bolt borehole is drilled, and a second anchor bolt borehole is then drilled positioned away from the first borehole by x.

In the installation of the circular type of composite anchor bolt 310, when reinforcement is encountered when drilling a borehole for the first anchor bolt, a core is removed of the diameter ϕP×depth H on the same axis. Next, the arrangement of the reinforcement is confirmed, and a borehole is drilled for the second anchor bolt at a point where reinforcement does not exist. An adhesive capsule is then injected and the circular type of composite anchor bolt 310 is installed. Following this, adhesive is injected through adhesive injection port 324. Lastly, the adhesive is left to cure to complete the installation.

The installation for the circular type composite anchor bolt 310 can be carried out in the same manner if the surface configuration of the connecting part is triangular, quadrangular, or even polygonal.

Also, for the composite anchor bolt in the third embodiment, the first and second anchor points can be constructed of different diameters, similar to the second embodiment. In this manner, in the composite anchor bolt of the present embodiment, even if tensile force T(KN) acts on first anchor bolt 14, 214, 314, projecting portion 17, 217, 317 of connecting part 12, 212, 312 exerts a compressive force (adherence in the case of 317) on the joining face with concrete frame 18, 218, 318, and the strength is therefore improved without increasing the thickness of the connecting part above the covering margin in reinforcement frame 20, 220, 320. Consequently, while in the prior composite anchor bolt, it was not possible to add the adherence of the concrete of the connecting part against the tensile force because of the strain generated in the connecting part (the connecting part shifts with an increase in tensile force T(KN)), but this has now been substantially improved in the embodiment.

Adapting this theory to the large type of anchor bolt, as in the second and third embodiment, connecting part 212, 312 is formed in a circular configuration (triangular, quadrangular, polygonal are also possible), the strength of the large anchor bolt construction which suffers from large tensile force on the first anchor bolt can be remarkably increased because of the increased compressive force area and adhering area. Due to the several fold increase of the compressive area or the adhering area in section, a composite anchor bolt can therefore be used as a post construction anchor bolt for the large diameter anchor bolt.

In particular, measurement H (thickness: reinforcement covering margin) of the connecting part in the composite anchor bolt is determined by the depth of the reinforcement in the concrete frame (approximately 30-60 mm), but the size of ϕP is set according to the necessary compressive force area, the necessary adhering area, and the workability. Also, the connecting part can be constructed so that several small communicating holes for injecting the adhesive are freely positioned on the connecting part, so that the adhesive permeates completely throughout the circumference of the connecting part, thereby guaranteeing the adhesive strength.

The connecting part can be formed in various configurations, such as circular, triangular, quadrangular, and polygonal. In order to increase the adhering area with the concrete on the sides and underside, it can be provided with an uneven surface configuration.

Figure 16:
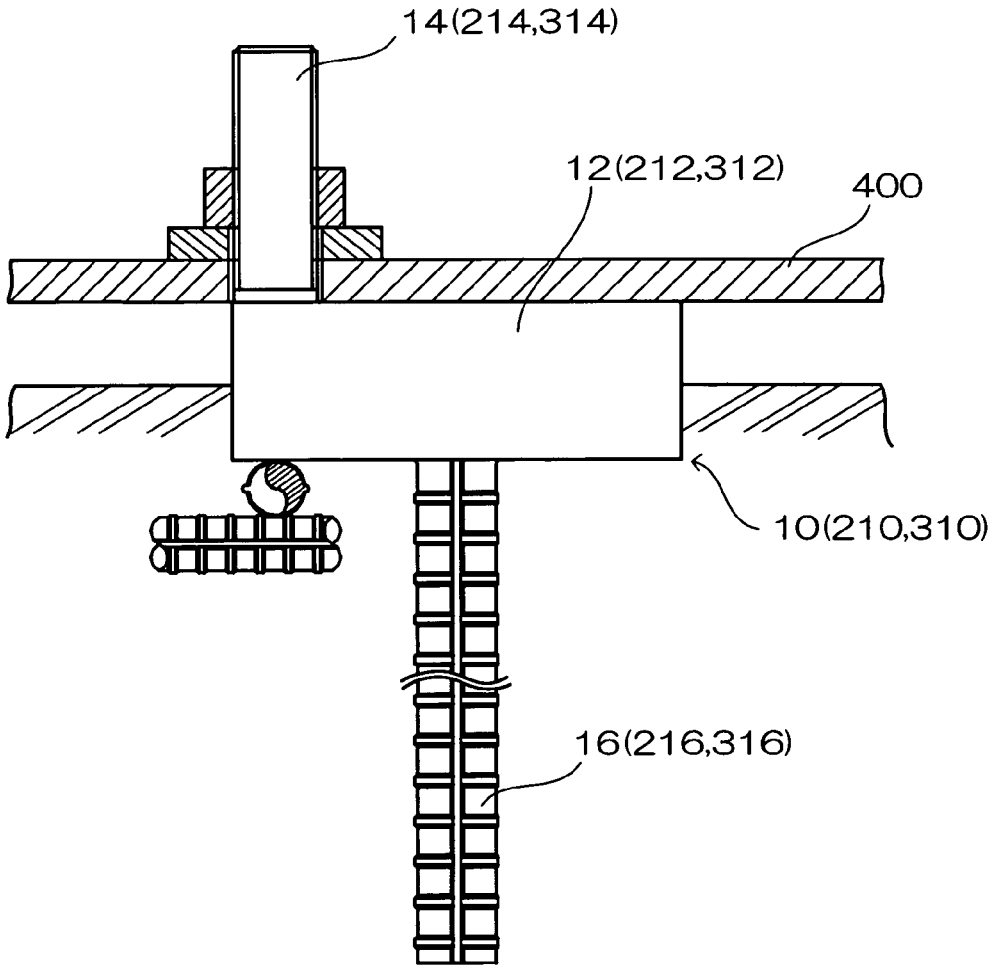
FIG. 16 is a side view of a variation embodiment which is in embedded state thereof.
Figure 17:
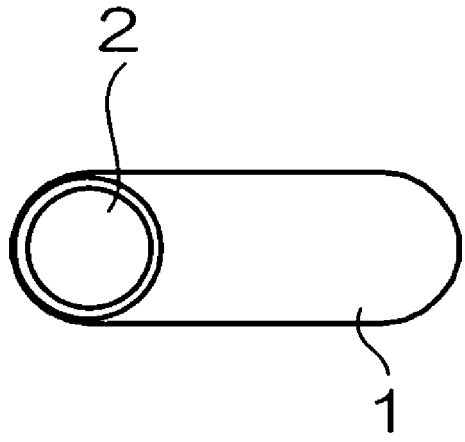
FIG. 17 is a plan view of a conventional composite anchor.
Figure 18:
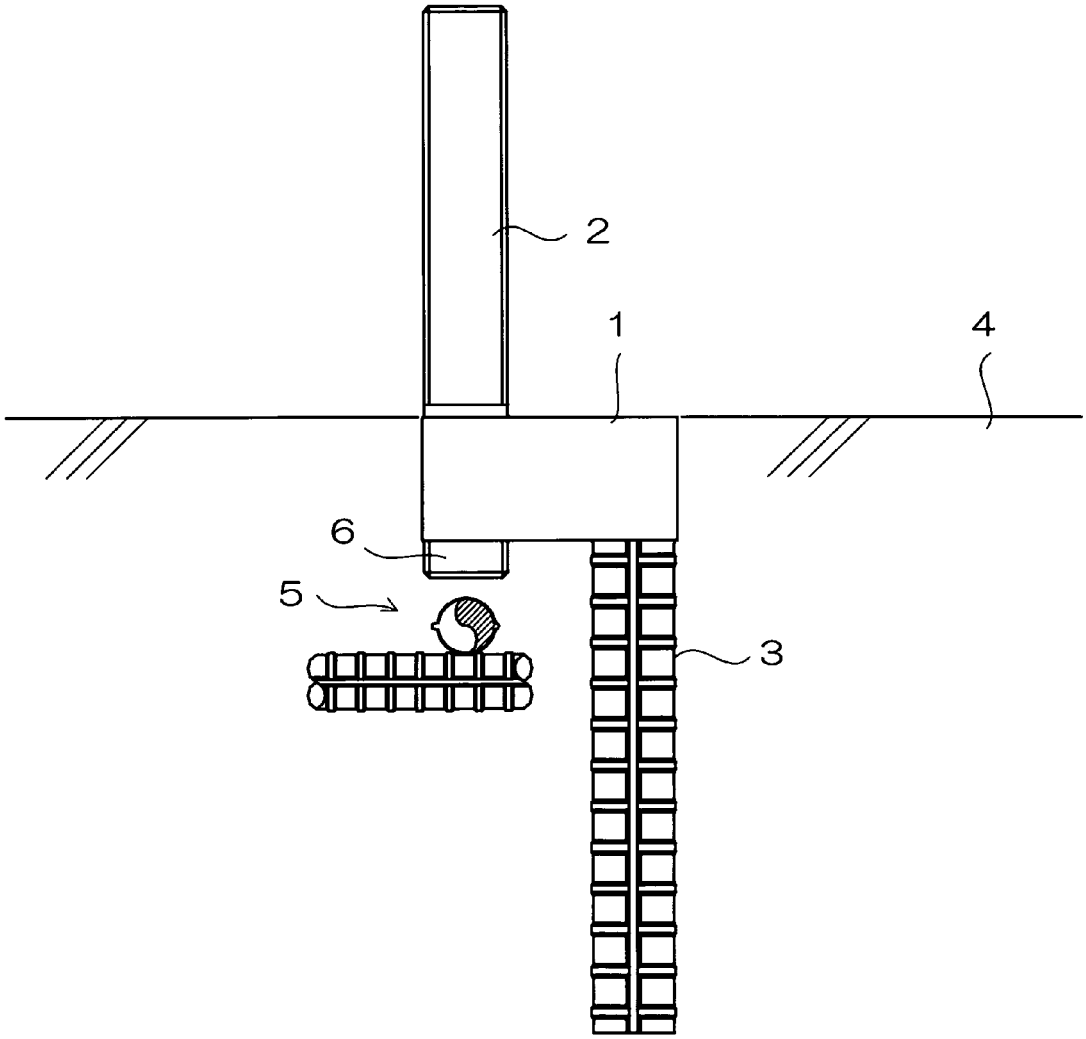
FIG. 18 is a side view of the conventional composite anchor bolt.
Figure 19:
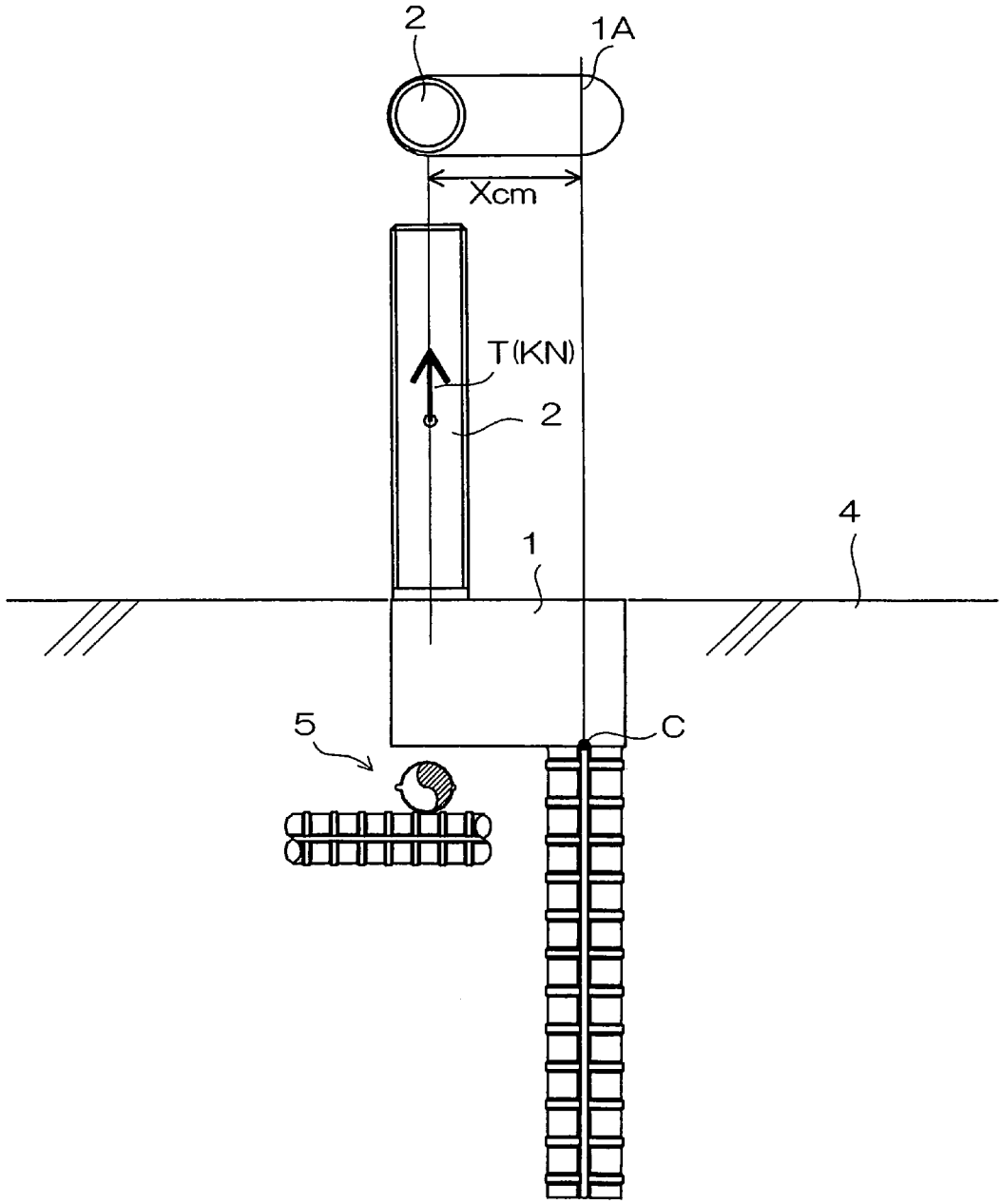
FIG. 19 is a schematic diagram showing configuration of a conventional large composite anchor bolt.

In addition, in the aforementioned explanation, it is conditional that a mountable object is fixed directly to the concrete surface by means of the anchor. In fact, however, gaps or space can exist between the concrete surface and a mountable object. Therefore, said connecting part 12, 212, 312 is sometimes installed raised from the concrete frame. In FIG. 16, which depicts this state, connecting part 12, 212, 312 is half-embedded in the concrete frame, a portion of it projects from the concrete frame surface, equipment base 400 is placed on it and is attached with first anchor bolt 14 (214, 314).

INDUSTRIAL UTILITY

In civil and building construction and machinery and appliances construction, reinforcement is encountered in concrete walls, floors, and ceilings when an borehole is being drilled for anchor bolt installation. The composite anchor bolt of the present invention can thus be used in operations for fixing various equipment to the surface of a concrete wall, so that it is embedded correctly while avoiding interference with the reinforcement.

What is claimed is:

1. A method of installing a composite anchor bolt comprising:

preparing a composite anchor bolt including a first anchor bolt and a second anchor bolt positioned eccentrically in a direction perpendicular to each other with a planar connecting part connecting the first and second anchor bolts, the first anchor bolt projecting on the outside of a matrix in which the composite anchor bolt is embedded and the second anchor bolt being positioned eccentrically to the first anchor bolt relative to the planar connecting part projecting inside the matrix;

removing a cylindrical or polygonal core from a reinforcement covering margin to confirm a position of a reinforcement within the matrix, the core corresponding to the shape of the connecting part, and surrounding the borehole;

drilling a borehole for the second anchor bolt; and jointly attaching the composite anchor bolt, wherein the planar connecting part extends radially from the first anchor bolt to and past the second anchor bolt.

2. The method of installing a composite anchor bolt according to claim 1, wherein, after the second anchor bolt is set into the drilled borehole, an adhesive is injected into an adhesive injection hole which is formed in the connecting part, air is released from an air hole which is formed in the connecting part, and the composite anchor bolt is attached.

3. The method of installing a composite anchor bolt according to claim 1, wherein a portion of the connecting part is projected outside from the concrete frame, and an equipment base is placed on the connecting part and attached with the first anchor bolt.

4. A combination of a composite anchor bolt and a concrete frame, the composite anchor bolt comprising:

a first anchor bolt configured to be installed projecting outside of a of the concrete frame;

a second anchor bolt that is eccentrically positioned to an axis of the first anchor bolt; and a connecting part that connects the first anchor bolt and the second anchor bolt, the first anchor bolt and the second anchor bolt being attached to the connecting part, wherein the connecting part extends radially from the first anchor bolt to and past the second anchor bolt, the second anchor bolt being located in a radial center of the connecting part, thereby reducing the bending moment that is exerted locally on the connecting part when a load is applied on the first anchor bolt, at least the second anchor bolt and the connecting part are integrally molded in one piece, and the connecting part is embedded in the concrete frame such that a planar side of the connecting part from which the first anchor bolt extends is flush with a surface of the concrete frame and accessible to an equipment base.

5. The combination of the composite anchor bolt and the concrete frame according to claim 4, wherein a planar configuration of the connecting part is made to be a polygonal or circular shape, thereby increasing the compressive force transfer area.

6. The combination of the composite anchor bolt and the concrete frame according to claim 4, wherein the connecting part is formed to have top and bottom surfaces of a polygonal or circular shape, and the second anchor bolt is positioned at the center of the connecting part.

7. The combination of the composite anchor bolt and the concrete frame according to claim 4, wherein the connecting part has an injection hole for an adhesive and an air hole.

8. The combination of the composite anchor bolt and the concrete frame according to claim 4, wherein both the first anchor bolt and the second anchor bolt have the same diameters.

9. The combination of the composite anchor bolt and the concrete frame according to claim 4, wherein the second anchor bolt has a larger diameter than the first anchor bolt.

10. The combination of the composite anchor bolt and the concrete frame according to claim 4, wherein both the first anchor bolt and the second anchor bolt have different diameters.

11. A combination of a composite anchor bolt and a concrete frame, the composite anchor bolt comprising:

a first anchor bolt configured to be installed projecting outside of the concrete frame;

a second anchor bolt that is eccentrically positioned to an axis of the first anchor bolt; and a connecting part that connects the first anchor bolt and the second anchor bolt, the first anchor bolt and the second anchor bolt being attached to the connecting part, wherein the connecting part and second anchor bolt are formed together in a T-shape configuration, and the first anchor bolt is placed at an edge of the connecting part, at least the second anchor bolt and the connecting part are integrally molded in one piece, and the connecting part is embedded in the concrete frame such that a planar side of the connecting part from which the first anchor bolt extends is flush with a surface of the concrete frame and accessible to an equipment base.

12. The combination of the composite anchor bolt and the concrete frame according to claim 11, wherein the first anchor bolt is removably attached to the connecting part.

13. The combination of the composite anchor bolt and the concrete frame according to claim 11, wherein both the first anchor bolt and the second anchor bolt have different diameters.

* * * * *